US005785633A

United States Patent [19]

Stroppiana

[11] Patent Number: 5,785,633

[45] Date of Patent: Jul. 28, 1998

[54] PLAY APPARATUS WITH A BALL-LIKE BODY AND A SADDLE

[75] Inventor: Fiorindo Stroppiana, Gallo D'Alba, Italy

[73] Assignee: Mondo S.P.A., Gallo D'Alba, Italy

[21] Appl. No.: 799,393

[22] Filed: Feb. 11, 1997

[30] Foreign Application Priority Data

Nov. 27, 1996 [IT] Italy ..... TO96A0963

[51] Int. Cl.[6] ..... A63B 26/00

[52] U.S. Cl. ..... 482/77; D21/66

[58] Field of Search ..... 482/77; D21/66; 446/29, 220, 486

[56] References Cited

U.S. PATENT DOCUMENTS

| | | |
|---|---|---|
| D. 161,305 | 12/1950 | Bernstein . |
| D. 163,253 | 5/1951 | Burkes . |
| D. 163,254 | 5/1951 | Burkes . |
| D. 212,243 | 9/1968 | Bennett . |
| D. 216,644 | 2/1970 | Nicholls . |
| D. 217,978 | 7/1970 | Raphael et al. . |
| D. 222,091 | 9/1971 | McDermott et al. . |
| D. 222,807 | 1/1972 | Davis . |
| D. 223,675 | 5/1972 | Raphael . |
| D. 231,790 | 6/1974 | Raphael . |
| 1,594,479 | 8/1926 | Swofford . |
| 2,884,247 | 4/1959 | Johns . |
| 3,122,377 | 2/1964 | Mortenson . |
| 3,195,890 | 7/1965 | Salls . |
| 3,520,534 | 7/1970 | Bennett et al. . |
| 4,037,833 | 7/1977 | Anderson . |
| 4,081,182 | 3/1978 | O'Brien . |
| 4,693,467 | 9/1987 | Ikäheimo . |
| 4,696,467 | 9/1987 | Markow . |
| 5,301,441 | 4/1994 | Kownacki . |

FOREIGN PATENT DOCUMENTS

| | | |
|---|---|---|
| 037091 | 7/1996 | WIPO . |

*Primary Examiner*—Lynne A. Reichard
*Attorney, Agent, or Firm*—Rothwell, Figg Ernst & Kurz, P.C.

[57] ABSTRACT

The play apparatus has a ball-like body and a saddle forming a seat for the user who sits astride the saddle gripping the apparatus by means of a handle situated on the front end of the saddle. The region in which the saddle is anchored to the ball-like body is situated in the vicinity of the handle.

14 Claims, 2 Drawing Sheets

PLAY APPARATUS WITH A BALL-LIKE BODY AND A SADDLE

DESCRIPTION

The present invention relates to play apparatus with a ball-like body and a saddle according to the preamble to claim 1.

Play apparatus of the type specified above has been proposed in recent years as a development of the conventional play apparatus constituted by a ball which can be ridden by the user of the apparatus who grips it by means of a gripping element such as a handle fitted on the ball. In use, the user sits astride the ball and begins to jump on the ball. The bouncing motion thus created enables the user, who holds the ball and drags it along gripping it by the handle, to move along the ground in hops with a movement approximately comparable to the galloping of a horse.

Various problems arise when the ball is associated with a sitting element or saddle to form a seat for the user, and these can be attributed to the fact that it is necessary to anchor the seat to the body of the ball in some way. In some known solutions in which the saddle is fixed centrally to the ball-like body, the saddle structure amplifies the pulling force exerted by the user in dragging the apparatus along, transforming the force into a very forceful stress on the body of the ball. This pulling force then often brings about rotary and/or overturning movements of the saddle and of the apparatus as a whole, with a consequent risk that the user may fall.

The object of the present invention is to provide a solution in which the aforementioned problems are eliminated.

According to the present invention, this object is achieved by virtue of a solution having the characteristics recited in the following claims.

Figure 1:
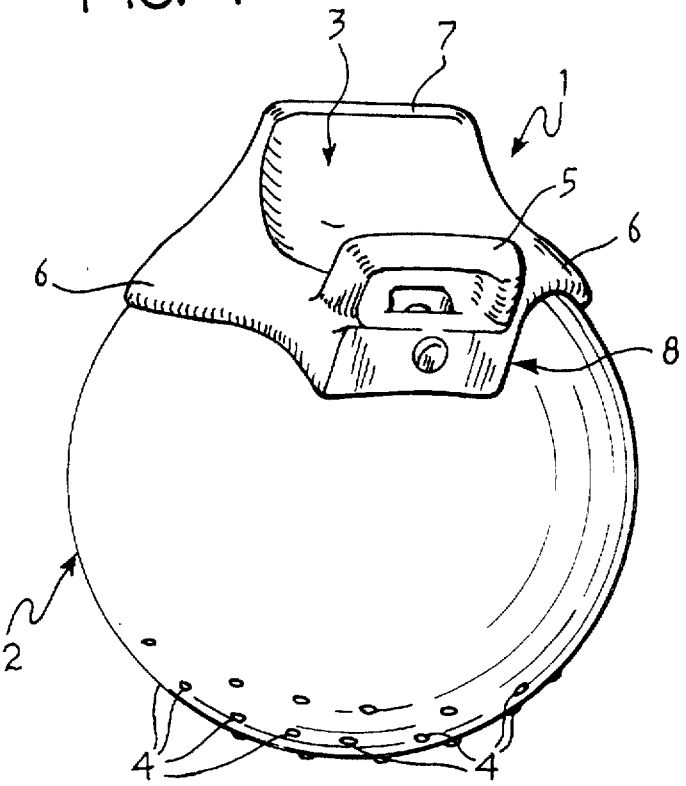
Figure 2:
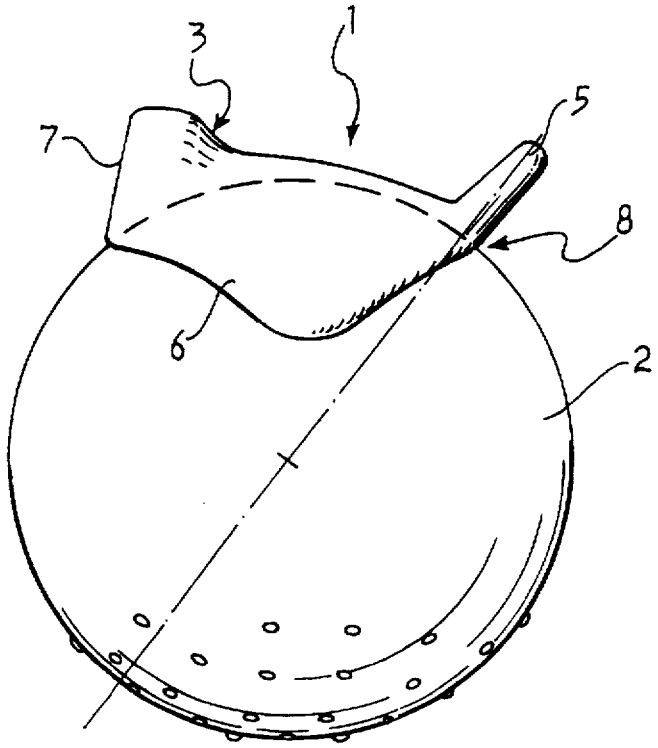
Figure 3:
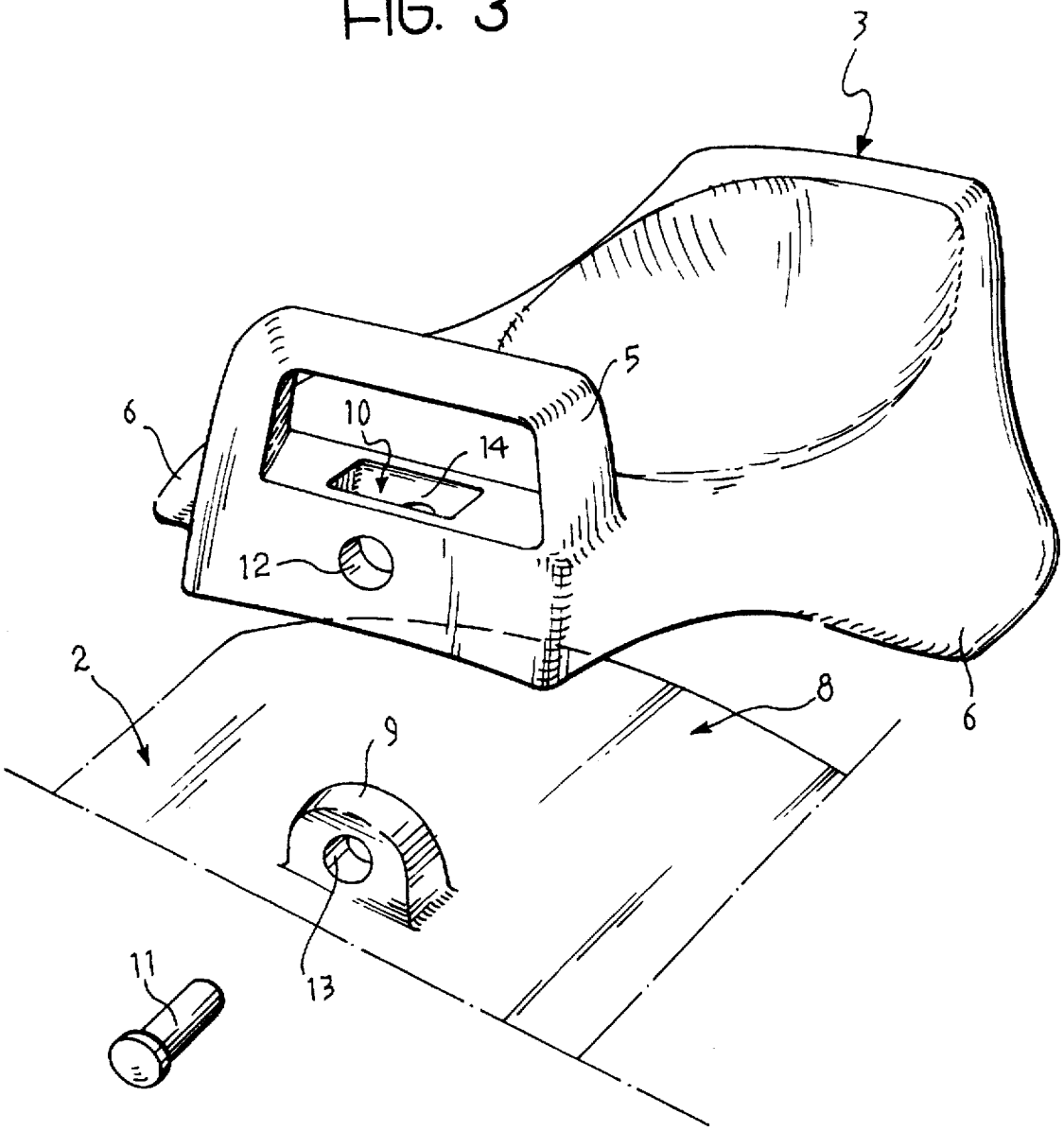

The invention will now be described, purely by way of non-limiting example, with reference to the appended drawings, in which:

FIG. 1 is a general perspective view of play apparatus formed in accordance with the invention, FIG. 2 is a side elevational view of the apparatus of FIG. 1, shown schematically in order better to illustrate the principle of the invention, and FIG. 3 is a general, exploded, perspective view showing the connection between some component parts of the apparatus according to the invention.

Play apparatus, generally indicated 1 in the appended drawings, comprises, according to a known solution:

a ball-like body 2 usually constituted by a selectively inflatable, hollow ball of plastics material with a diameter of the order of, for example, from 50–70 cm, such as to allow the ball 2 to be ridden by a child, or by the user of the apparatus in general, and a seat fixed to the ball-like body 2 and constituted essentially by an element 3 (for example, of moulded plastics material) having the appearance of a saddle.

The ball-like body 2 preferably has projections 4 having an anti-slip function on its lower portion which is intended to face the ground.

The saddle-like element 3 has, at its front end, (naturally, with reference to the normal arrangement of use of the apparatus, which is the known arrangement referred to briefly in the introductory part of the description) a gripping handle 5 which enables the user to grip the apparatus in use, supporting himself astride it.

The surface of the saddle 3 which is intended to face the ball-like body 2 (and hence the lower surface in the normal position of use) has a generally bowl-like shape, preferably with a spherical profile the radius of which corresponds substantially to the radius of the ball-like body 2 in the inflated condition.

In a preferred embodiment of the invention, the saddle 3 has a generally cap-like shape with a generally lobed outline (see the lower view of the element 2 shown in FIG. 3) with a profile approximately comparable to a pentagonal or, rather, manta-ray-shaped profile.

In particular, two lateral wings 6 can be distinguished within this profile and, when the saddle 3 is mounted on the ball-like body 2, these extend sideways (relative to the direction of advance of the apparatus 1 in use) like the flaps of a horse's saddle so as to extend around the ball-like body 2 through an angle (with reference to the centre of the ball-like body 2) of the order of 20°–30° or more. This value corresponds approximately to the angular extent of the saddle 3 viewed from front to rear (again with reference to the normal direction of advance in use). In the preferred embodiment of the invention, the saddle 3 is thus formed so as to "embrace" the ball-like body 2 quite extensively so as to ensure that the saddle 3 is arranged firmly on the body 2.

Again in a preferred embodiment, the saddle has a raised portion 7 or cantle (according to current terminology for saddles for horse-riding) at the opposite end to the handle 5, and hence in a rear position in the normal direction of advance, for exerting a certain restraint on the user's body, preventing the user from accidentally slipping backwards and falling off the apparatus during use.

An important characteristic of the solution according to the invention is that the connection between the saddle 3 and the ball-like body 2 is formed in an anchoring region, indicated 8, situated at the front of the element 3, in practice, in the vicinity of the handle 5.

The advantages of this arrangement can readily be seen from the elevational view of FIG. 2.

In the first place, the pulling force exerted by the user on the handle 5 is transferred to the ball-like body 2 in a radial direction, passing through the anchoring region 8.

This prevents the problems which arise when the region in which the saddle 3 is anchored to the ball-like body 2 is further towards the rear of the saddle 3, that is: the amplification of the pulling force exerted by the user to the level of a force detaching the saddle 3 from the ball-like body 3, the development of a net rearward pitching moment (with a consequent risk of overturning) and, possibly, rotation effects about the vertical axis (yawing) with consequent further risks of falling.

The described arrangement of the anchoring region 8, in combination with the extensive generally bowl- or cap-like shape of the saddle 3 also means that the inflation of the ball-like body 2, with consequent tensioning of the wall region of the body 2 corresponding to the anchoring region 8, results in a further strengthening of the connection of the saddle 3 to the body 2.

A solution which has been found particularly advantageous for the formation of an anchoring region 8 having the aforementioned characteristics is shown in FIG. 3.

According to this solution, an engagement element formed on the ball-like body 2 is constituted, in practice, by an eye or lug 9 projecting from the body 2.

An eye or lug of this type may be constituted by a separate element fitted on the surface of the ball-like body 2, for example, by gluing or heat-sealing. The currently-preferred solution, however, provides for the eye or lug 9 to be formed as an integral part of the ball-like body 2 during the moulding thereof by a corresponding modification of the respective mould.

This solution has undoubted advantages both for the firmness of the connection resulting from integral manufacture and because, as already mentioned above, the fact that the respective region of the wall of the body 2 is taughtened when the ball-like body 2 is inflated causes a tensile stress to be applied longitudinally to the arch of the eye or lug element.

This stress has the effect of pulling the saddle 3 (which is connected to the eye or lug 9—as will be described further below) to a position in which it is even more firmly connected to the body 2. The aforesaid tension effect is developed even more preferably when the arch portion of the eye or lug 9 is hollow and thus has a tubular structure, which can be achieved by corresponding metering of the moulding material used to form the ball-like body 2.

Again in FIG. 3, it can be noted that the lower face of the saddle 3 has a recess 10 (which may be open, and hence also appearing on the upper and outer surface of the saddle 3, or blind, the selection being unimportant and being dictated mainly by production requirements during the moulding of the element 3) in which the eye or lug 9 can be inserted in order thus to be held in place, the fixing of the saddle 3 the ball-like body 2 being ensured by means of a pin 11. The pin 11, usually made of plastics material, is intended to be inserted in a hole 12 in the outer edge of the element 3 at the base of the handle 5 in order thus to extend through the hole 13 in the eye or lug 9 and finally to enter a further hole 14 in the wall of the cavity 10 facing towards the interior of the saddle 3.

Clearly, however, although the fixing solution described is currently considered preferable, it is not in fact essential for the purposes of the implementation of the invention. In fact, the principle of the invention remaining the same, the details of construction and forms of embodiment of all of the elements described above may be varied widely, without thereby departing from the scope of the present invention.

What is claimed is:

1. A play apparatus comprising a ball member, and a saddle member attached to the ball member and astride which a user sits, the saddle member having a handle which the user grips and being attached to the ball member at an anchoring region of the saddle member, the anchoring region being in the vicinity of the handle.

2. The play apparatus of claim 1, wherein the saddle member is cap-shaped and extends both laterally and fore-and-aft so as to wrap partially around the ball member.

3. The play apparatus of claim 2, wherein the saddle member extends laterally so as to wrap around an arcuate portion of the ball member of approximately twenty to approximately thirty degrees.

4. The play apparatus of claim 2, wherein the saddle member extends fore-and-aft so as to wrap around an arcuate portion of the ball member of approximately twenty to approximately thirty degrees.

5. The play apparatus of claim 1, wherein the saddle member has an inner surface which faces the ball member, said inner surface being generally spherical.

6. The play apparatus of claim 1, wherein the saddle member has two laterally extending, flap-shaped side portions.

7. The play apparatus of claim 1, wherein the handle and the anchoring region are located generally at the front of the saddle member.

8. The play apparatus of claim 1, wherein the saddle member has a raised, cantle portion at a rear portion thereof.

9. The play apparatus of claim 1, wherein the saddle member is attached to the ball member by engagement means comprising at least one eye or lug member.

10. The play apparatus of claim 9, wherein the eye or lug member comprises an integral part of the ball member.

11. The play apparatus of claim 9, wherein the eye or lug member is hollow and has a tubular configuration.

12. The play apparatus of claim 9, wherein the engagement means comprise a recess formed in the saddle member and which receives the eye or lug element.

13. The play apparatus of claim 12, wherein the eye or lug element is secured within the recess by means of a pin member.

14. The play apparatus of claim 13, wherein the pin member extends through at least one hole that is adjacent the recess.

* * * * *